US011659948B2

(12) United States Patent
Farentinos et al.

(10) Patent No.: US 11,659,948 B2
(45) Date of Patent: May 30, 2023

(54) MAIL RECEPTACLE WITH VARIABLE CARRIER AND RECEIVER ACCESS POINTS

(71) Applicant: Architectural Mailboxes, LLC, Redondo Beach, CA (US)

(72) Inventors: Christopher Andrew Farentinos, Redondo Beach, CA (US); Vanessa Felicia Troyer-Farentinos, Redondo Beach, CA (US); Craig Ronald Steele, Hawthorne, CA (US); Taylor S. Johnson, Orange, CA (US)

(73) Assignee: Architectural Mailboxes, LLC, Redondo Beach, CA (US)

( * ) Notice: Subject to any disclaimer, the term of this patent is extended or adjusted under 35 U.S.C. 154(b) by 0 days.

(21) Appl. No.: 17/378,871

(22) Filed: Jul. 19, 2021

(65) Prior Publication Data

US 2022/0022680 A1 Jan. 27, 2022

Related U.S. Application Data

(60) Provisional application No. 63/056,477, filed on Jul. 24, 2020.

(51) Int. Cl.
*A47G 29/22* (2006.01)
*A47G 29/20* (2006.01)
*A47G 29/124* (2006.01)

(52) U.S. Cl.
CPC ..... *A47G 29/22* (2013.01); *A47G 29/1251* (2017.08); *A47G 29/20* (2013.01)

(58) Field of Classification Search
CPC .. A47G 29/22; A47G 29/20; A47G 29/12095; A47G 29/1251; A47G 29/16; A47G 2029/144; A47G 2029/148
USPC ..... 232/45, 19, 38, 51
See application file for complete search history.

(56) References Cited

U.S. PATENT DOCUMENTS 1,506,646 A * 8/1924 Kolstad ..... A47G 29/1248 232/19
5,137,212 A * 8/1992 Fiterman ..... B65F 1/1468 109/66
5,833,132 A * 11/1998 Bachmeier ..... A47G 29/12095 232/47
6,109,519 A * 8/2000 McClure ..... A47G 29/1216 52/592.5
6,719,195 B2 * 4/2004 Farentinos ..... A47G 29/22 232/47

(Continued)

*Primary Examiner* — William L Miller
(74) *Attorney, Agent, or Firm* — Leydig, Voit & Mayer, Ltd.

(57) ABSTRACT

The disclosure provides an innovative delivery receptacle for receiving objects (such as parcels and mail) deposited into the receptacle and securely storing them once deposited. The receptacle allows for the orientation of the position of an input opening and delivery door for a delivering party, such as a courier, to deposit the objects in the receptacle to be changeable with respect to the orientation of an access opening and access door for a receiving party to remove the objects. In one embodiment, the delivery door also restricts access to the deposited objects while they are deposited into the receptacle. The receptacle may be a stand-alone receptacle or it may be a structure-mounted unit, such as installed in a wall or other structure. The receptacle may comprise a separate first and second sections that may be shipped separately and assembled with the desired orientation.

19 Claims, 13 Drawing Sheets

(56) References Cited

U.S. PATENT DOCUMENTS

| | | | | |
|---|---|---|---|---|
| 7,320,427 | B2 * | 1/2008 | Prestwich | A47G 29/22 232/51 |
| 7,946,472 | B2 * | 5/2011 | Bolles | A47G 29/22 232/51 |
| 8,485,424 | B1 * | 7/2013 | Taylor | A47G 29/16 232/38 |
| 8,573,473 | B1 * | 11/2013 | Farentinos | A47G 29/22 232/51 |
| D702,915 | S * | 4/2014 | Steele | D99/29 |
| 8,960,530 | B2 * | 2/2015 | Silke | A47G 29/22 232/47 |
| 9,004,346 | B2 | 4/2015 | Farentinos et al. | |
| 9,327,887 | B2 | 5/2016 | Farentinos et al. | |
| 9,717,359 | B2 * | 8/2017 | Bolles | A47G 29/1251 |
| 10,251,503 | B1 * | 4/2019 | Fulps | A47G 29/22 |
| 11,206,940 | B2 * | 12/2021 | Kaechele | A47G 29/12095 |
| 11,253,094 | B1 * | 2/2022 | Deck | A47G 29/30 |
| 11,503,936 | B2 * | 11/2022 | Leng | A47G 29/1251 |
| 2002/0063148 | A1 * | 5/2002 | Cox | A47G 29/16 232/47 |
| 2005/0104730 | A1 * | 5/2005 | Yang | A47G 29/141 340/569 |
| 2008/0067227 | A1 * | 3/2008 | Poss | H02J 9/005 340/569 |
| 2010/0127063 | A1 * | 5/2010 | Bolles | A47G 29/22 29/434 |
| 2019/0343317 | A1 * | 11/2019 | Cantrell | G07C 9/00563 |

* cited by examiner

MAIL RECEPTACLE WITH VARIABLE CARRIER AND RECEIVER ACCESS POINTS

CROSS REFERENCE TO RELATED APPLICATIONS

This patent application claims the benefit of, and priority to, U.S. Provisional Patent Application No. 63/056,477, filed Jul. 24, 2020, which is incorporated by reference herein in its entirety.

FIELD OF THE INVENTION

The field of the invention generally relates to receptacles for receiving objects while preventing unauthorized access to the received objects, and more specifically to delivery receptacles for receiving parcels and packages that have variable relative carrier and receiver access points. The receptacle may be formed of multiple attachable pieces in order to reduce the size of shipping containers in which the attachable pieces may be shipped by delivery services, such as the United States Postal Service (USPS), Federal Express, United Parcel Service (UPS), or other private carriers and delivery services, and the like.

SUMMARY OF THE INVENTION

This present invention is directed to a delivery receptacle that provides flexibility in how it is installed to provide the using parties different receptacle access points to suit the particular application. There are generally two parties who use delivery receptacles; 1) the party who delivers the item(s) being delivered (a deliverer, or courier), and 2) the recipient of the delivered item, or receiver. The point of desired receptacle access may differ for each party. This invention provides these parties flexibility in how they access the receptacle, depending on various factors, such as physical constraints of the installation location, proximity to roadways, relative positioning of sidewalks and paths, and installation into column, walls or fences. In this concept, the receptacle can be installed giving the courier one access point (e.g., deliver to the top front of the receptacle), and the receiver another access point (e.g., retrieve from the bottom rear of the receptacle). The same receptacle can be adjusted to accommodate other access points at the time of assembly and/or installation and/or even after assembly and/or installation, including during use, such that it not be pre-configured at the time of manufacture and held static at installation.

Accordingly, the present invention is directed to an innovative delivery receptacle for receiving objects (such as parcels and mail) deposited into the receptacle and securely storing them once deposited, which also allows the relative position of a delivery door for a delivering party (e.g., a courier or other deliverer) to deposit the objects in the receptacle, and an access opening often covered by a door for a receiving party (recipient) to remove the objects, while also often restricting access to the deposited objects after they are deposited into the receptacle. The receptacle may be a stand-alone receptacle or it may be a structure mounted unit (such as installation in a wall or other supporting structure).

The invention provides a receptacle for receiving and securing an object, comprising a housing including; i) a first section having an input opening located on a first side of the first section for receiving an object being deposited into the receptacle, and ii) a separate second section forming a storage compartment for receiving and securely storing an object deposited into the receptacle. A delivery door is located on the first side of the first section, with the delivery door rotatable between a closed position in which the delivery door blocks the input opening and an open position in which the delivery door allows access through the input opening to place an object into the receptacle and allow the object to enter into the storage compartment. An access opening is located on a first side of the second section and is configured to provide access to the storage compartment for removing objects deposited into the receptacle. An access door mounted on the first side of the second section rotatable between a closed position in which the access door blocks the access opening and an open position in which the access door allows access into the storage compartment for retrieving an object in the storage compartment. The first section and the second section are configured such that they can be positioned rotationally about a substantially vertical axis at different angular positions relative to each other to allow the input opening and the access opening to be located at different angular positions relative to each other while still allowing an object deposited through the access opening to enter into the storage compartment and be stored in the storage compartment.

Further and alternative aspects and features of the disclosed principles will be appreciated from the following detailed description and the accompanying drawings. As will be appreciated, the principles disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

15A is a perspective view of a second embodiment of the inventive receptacle in a second orientation with the delivery door in the partially open condition and the access opening covered by a door in the closed condition.

Figure 15B:
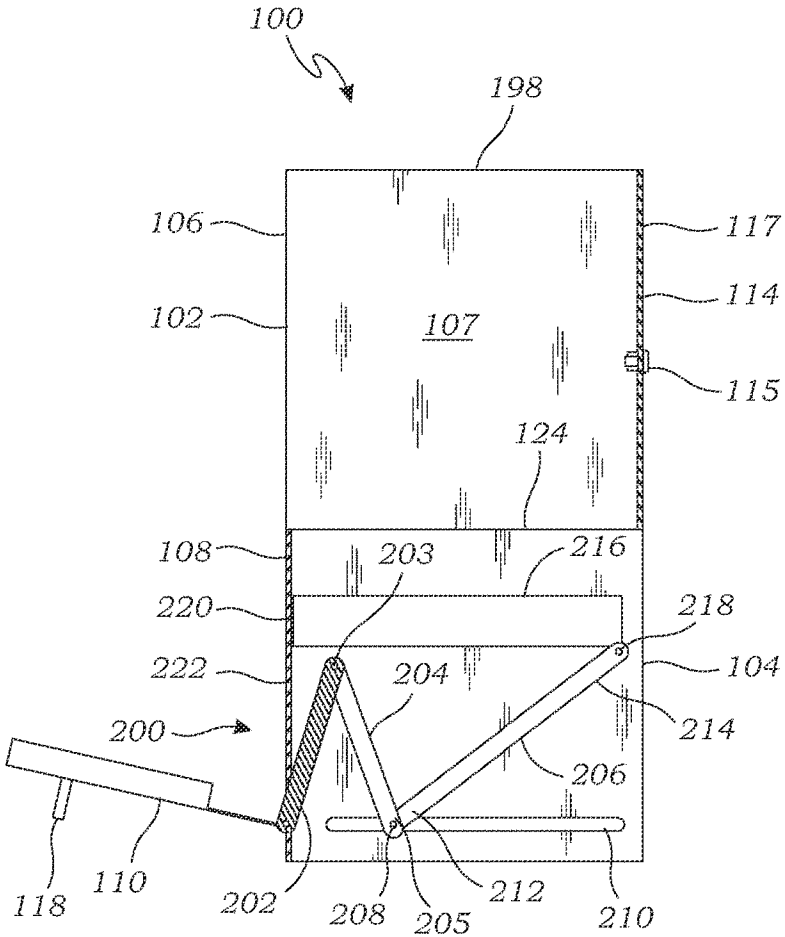
Figure 15A:
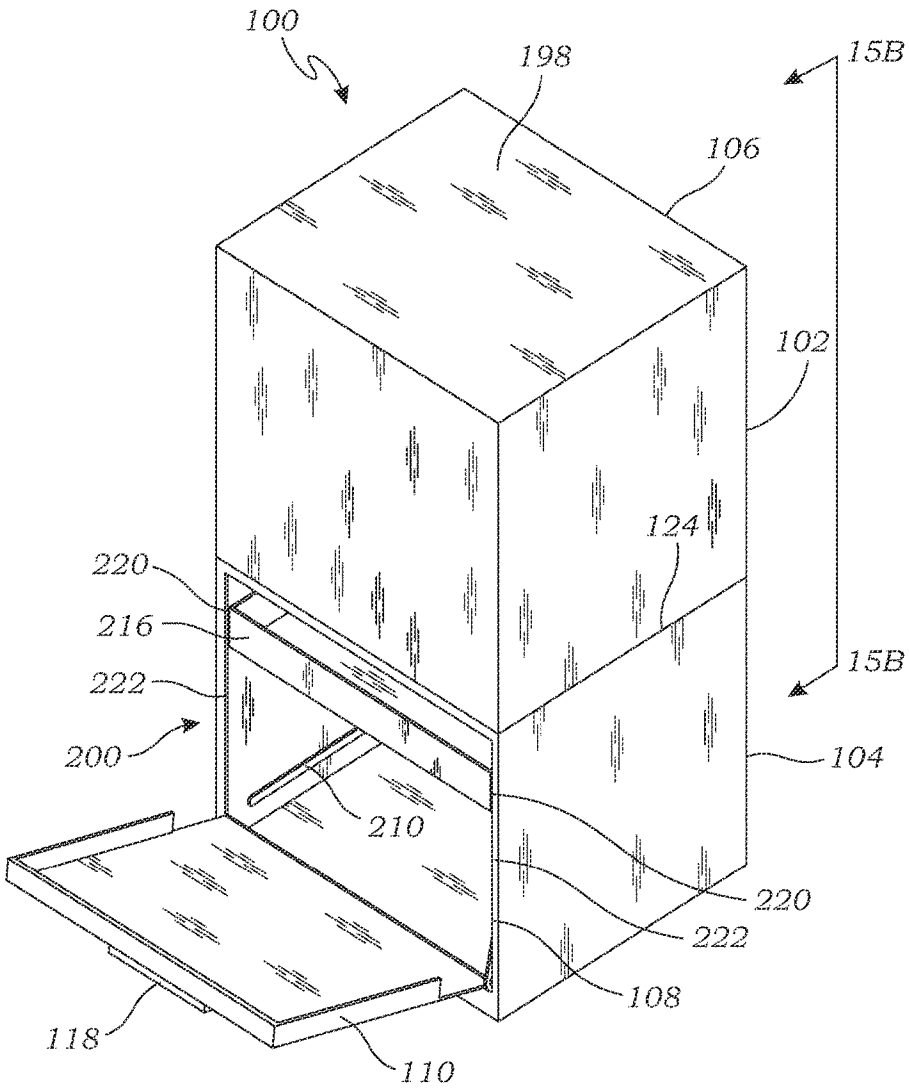

15B is a cross sectional side view of a second embodiment of the inventive receptacle in a second orientation taken along line 15B-15B of FIG. 15A.

Figure 13B:
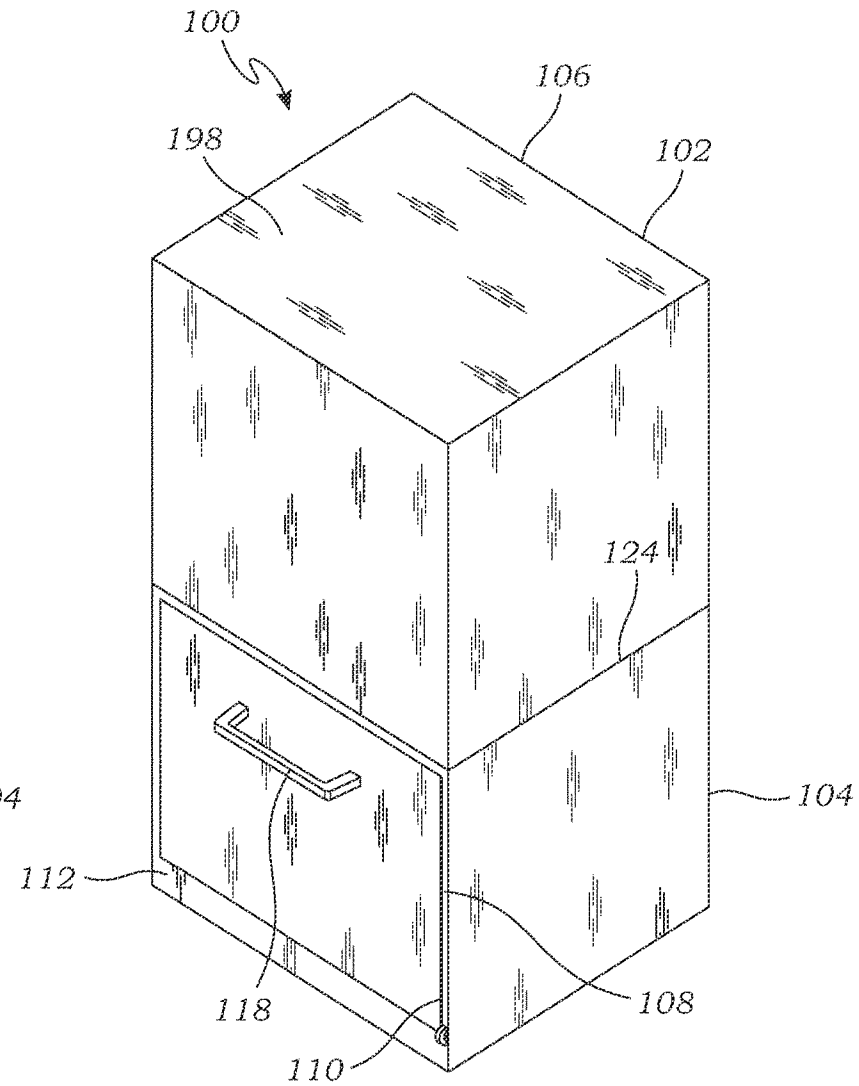
FIG. 13B is a perspective view of a second embodiment of the inventive receptacle in a second orientation with the delivery door and the access opening covered by a door in the closed condition.
Figure 16B:
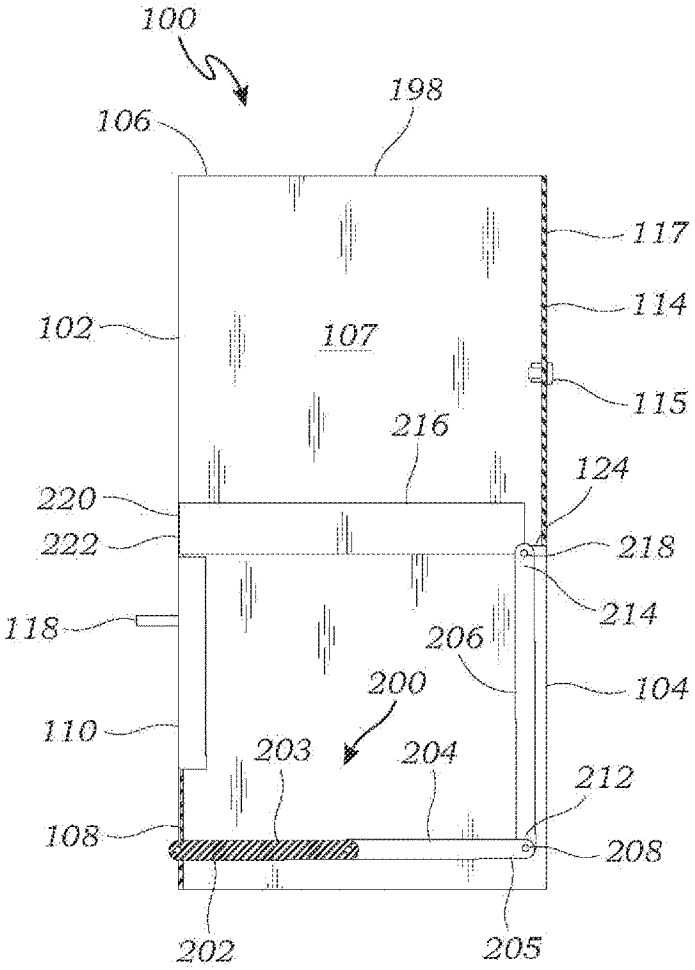
Figure 16A:
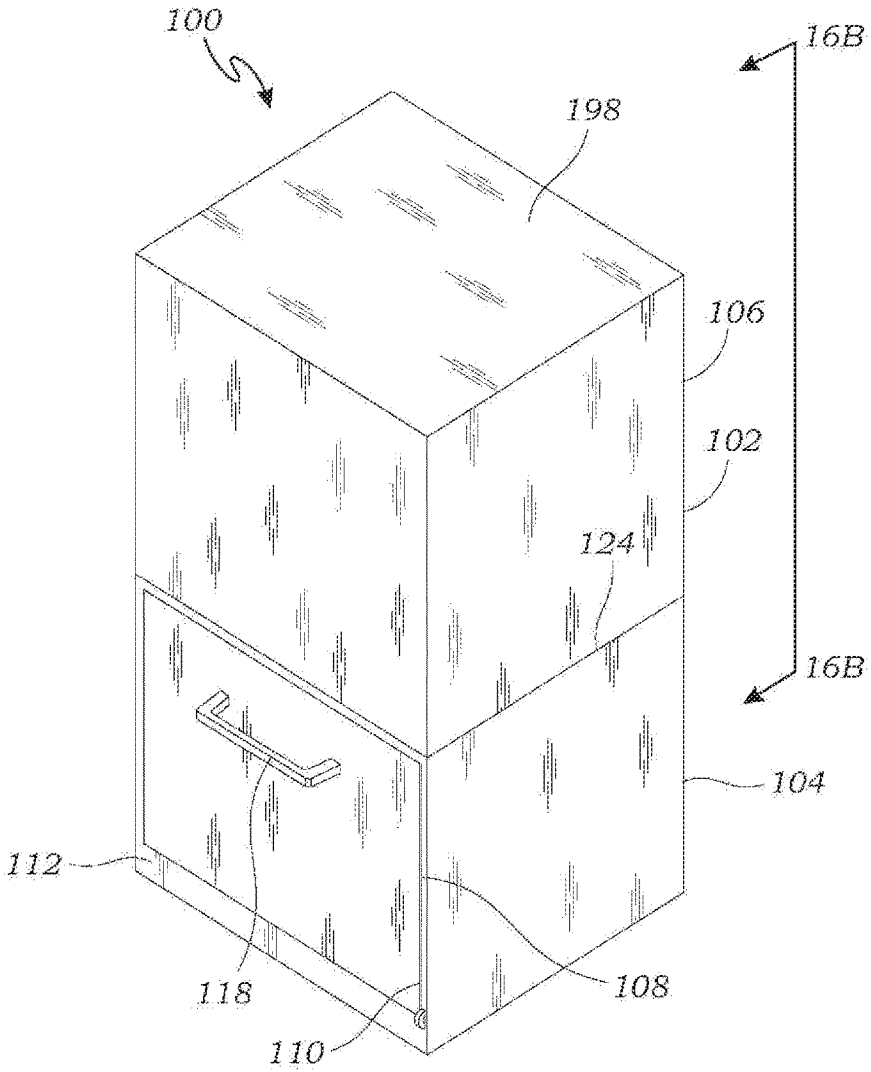

FIG. 16A is a perspective view of a second embodiment of the inventive receptacle in a second orientation with the delivery door and the access opening covered by a door in the closed condition similar to FIG. 13B.

16B is a cross sectional side view of a second embodiment of the inventive receptacle in a second orientation taken along line 16B-16B of FIG. 16A.

DESCRIPTION OF A PREFERRED EMBODIMENT

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice versa without limiting the scope of the disclosure to the exact number or type of such elements unless set forth explicitly in the appended claims. The terms configured and configuration may be used herein to refer to a specified arrangement, or a structural size and shape.

In one embodiment, as best shown in FIGS. 1-3, 7, and 10-12, a receptacle 100 for receiving and securing an object comprises a housing 102. The housing 102 includes, i) a first or top section 104 having an input opening 108 located on a first side 112 of the first or top section 104 for receiving an object being deposited into the receptacle 100 and ii) a separate second or bottom section 106 forming a storage compartment 107 for receiving and securely storing an object deposited into the receptacle 100. The second or bottom section 106 may also include an access opening 117 and access door 114. In one embodiment, the first section 104 with the input opening 108 and delivery door 110 is positioned on top of the second section 106 having the access opening 117 and access door 114. However, other embodiments with the second section 106 positioned above or beside the first section 104 are also contemplated by the invention as will be more fully described later.

Figure 1:
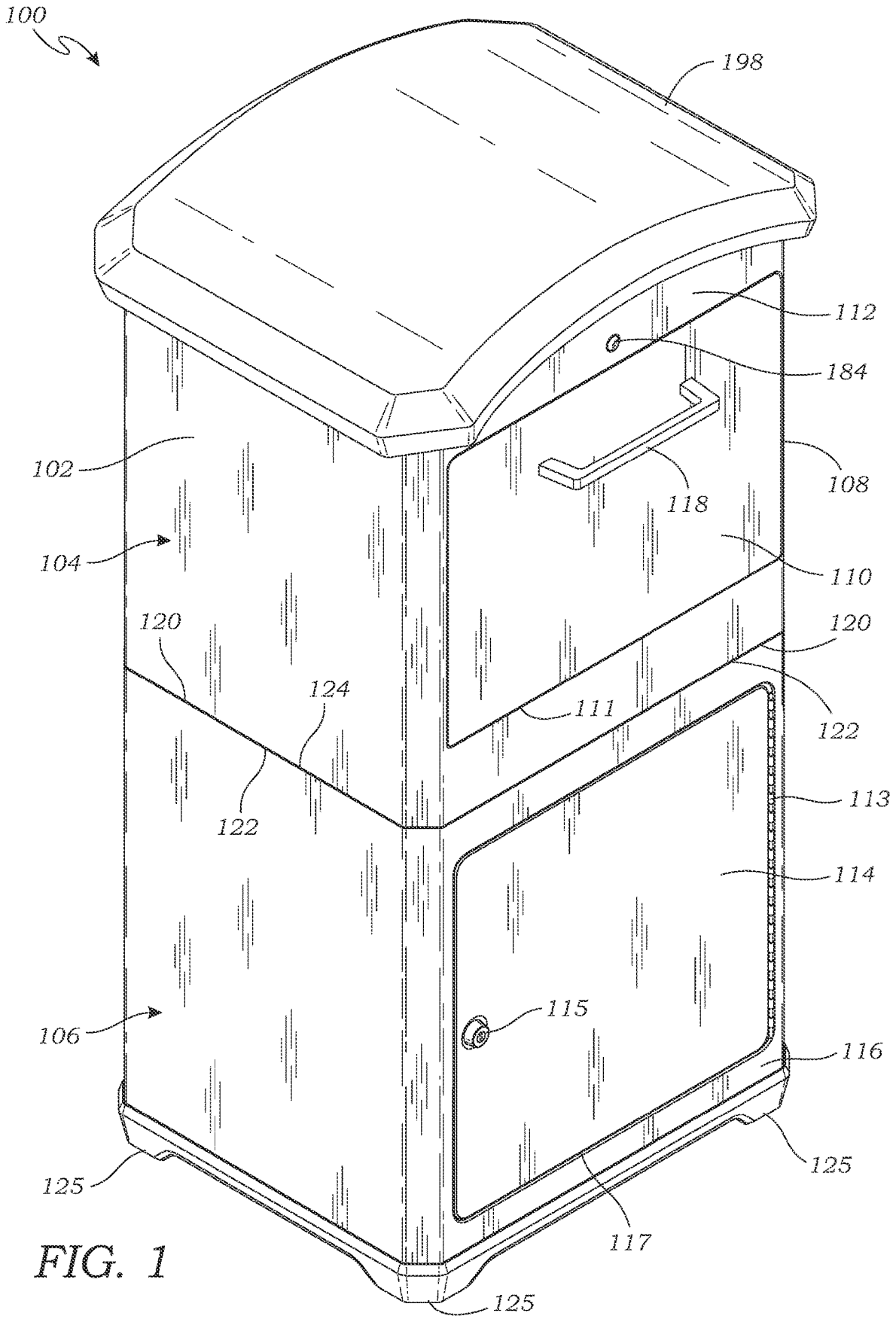
FIG. 1 is a perspective view of one embodiment of the inventive receptacle in a first orientation with the delivery door and the access opening covered by a door in the closed condition.

The receptacle 100 has a delivery door 110 located on the first side 112 of the first or top section 104. The delivery door 110 is rotatable between a closed position (as shown in FIG. 1) in which the delivery door 110 blocks the input opening 108, and an open position (see FIG. 2) in which the delivery door 110 allows access through the input opening 108 to place an object into the receptacle 100 and from which the object then enters into the storage compartment 107. In one embodiment, the delivery door pivots on a horizontal axis 111.

The second or bottom section 106 has an access opening 117 and access door 114 located on a first side 116 of the bottom section 106. The access door 114 is configured to provide access to the storage compartment 107 for removing objects deposited into the receptacle 100. In one embodiment, the access door 114 has a vertical hinge 113 and an access door lock 115 to lock and unlock the access door 114 to control authorized access.

Figure 11:
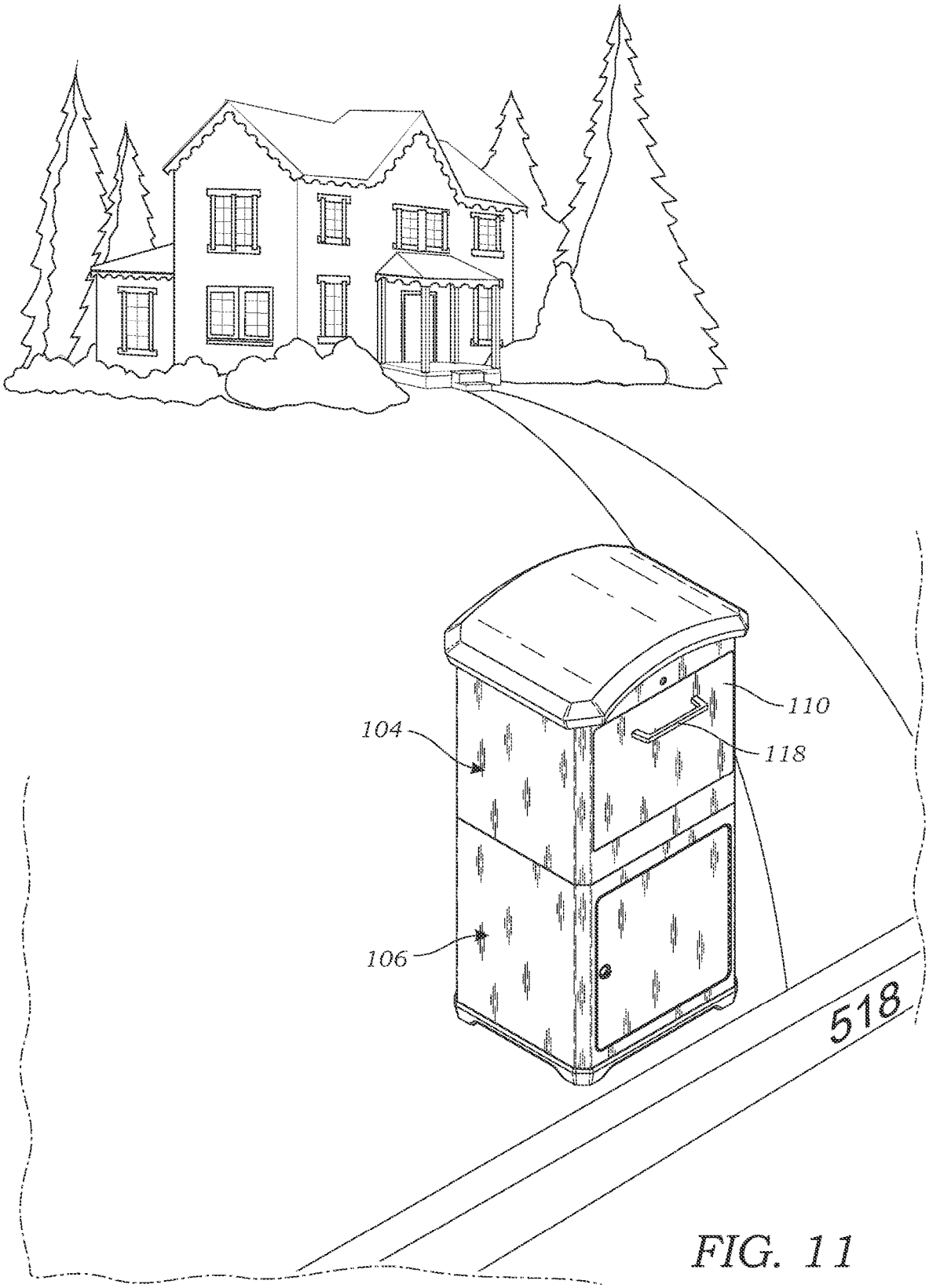
FIG. 11 is a perspective view of one embodiment of the receptacle in a first orientation.
Figure 12:
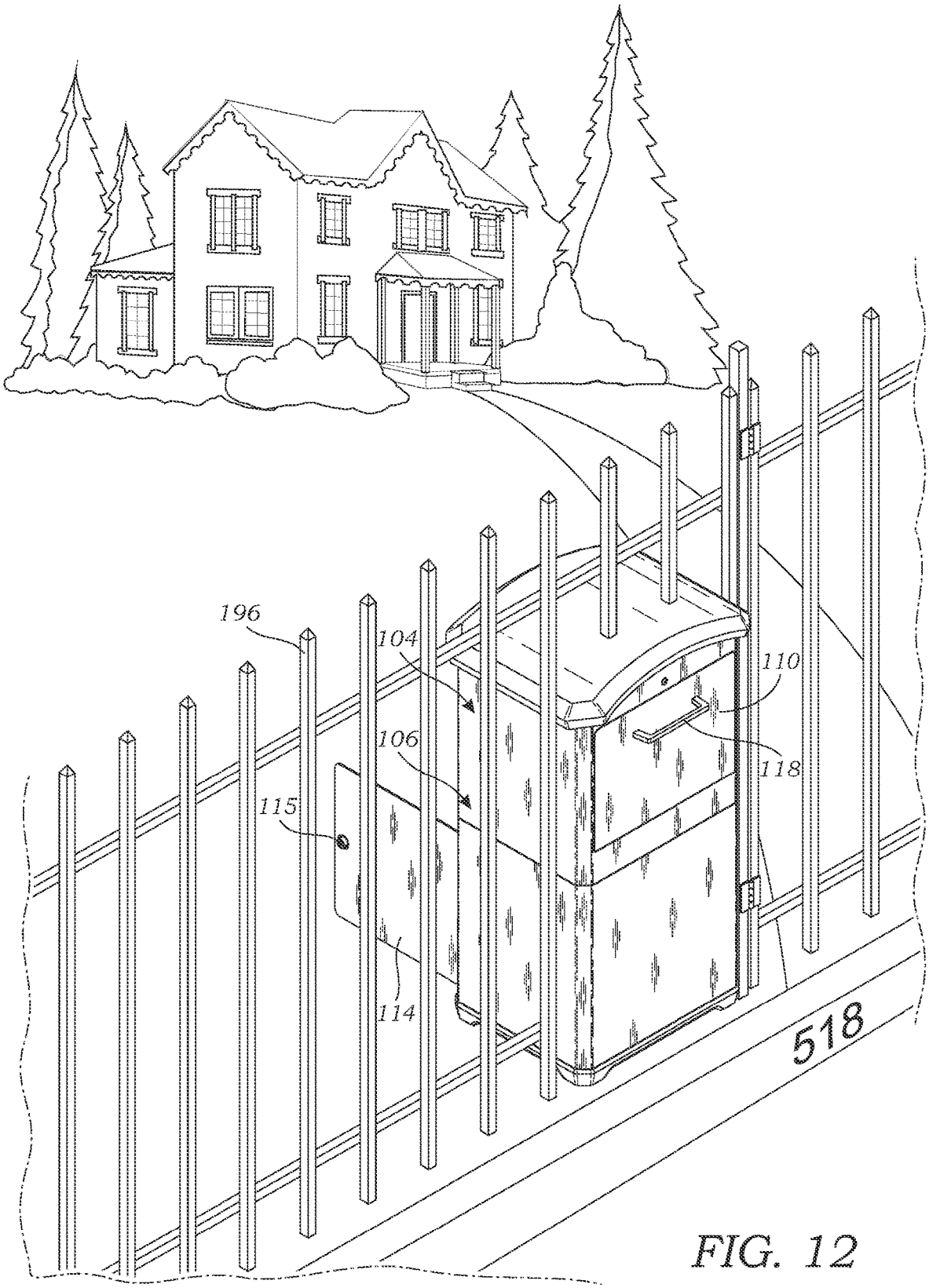
FIG. 12 is a perspective view of one embodiment of the receptacle in a second orientation with the door to the access opening in the open condition.

The first section 104 and the second section 106 are configured such that they can be positioned rotationally about a substantially vertical axis at different angular positions relative to each other to allow the delivery door 110 and the access door 114 to be located at different angular positions relative to each other while still allowing an object deposited through the delivery door 110 to enter into the storage compartment 107 and be securely stored in the storage compartment 107. FIGS. 11 and 12 show two relative angular positions of the first section 104 and the second section 106. FIG. 11 shows a configuration in which the first section 104 and second section 106 are positioned such that the delivery door 110 and access door 114 are both positioned on the same side of the receptacle 100. FIG. 12 shows the second section 106 rotationally positioned such that the access door 114 is located substantially behind the delivery door 110, i.e., delivery door 110 and access door 114 are positioned on opposite sides of the receptacle 100 or 180° from each other. Hence, if the position of the delivery door 110 is defined as the front of the receptacle 100, then the access door 114 is at the rear of the receptacle 100.

In the exemplary embodiment shown in FIGS. 1-12, the first section 104 and second section 106 have substantially square shapes (i.e., length of the sides are equal about a vertical axis), including at their connection interface. Accordingly, there are four different relative angular positions of the first section 104 and second section 106, and the corresponding input opening 108 and delivery door 110 on one hand and access opening 117 and access door 114, on the other hand including:

the access door 114 substantially vertically aligned with delivery door 110;

the access door 114 located to the right of the delivery door 110 (i.e. 90° to the right);

the access door 114 located to the left of the delivery door 110 (i.e. 90° to the left); and the access door 114 located substantially behind the delivery door 110 (i.e. 180° from the delivery door 110).

If the delivery door 110 is positioned at a front of the receptacle 100, then these positions can be described as:

the access door 114 positioned at the front of the receptacle 100 such that it is substantially vertically aligned with the delivery door 110;

the access door 114 angularly positioned about 90° to the right of the delivery door 110;

the access door 114 angularly positioned about 90° to the left of the delivery door 110; and the access door 114 angularly positioned at a back of the receptacle 100 at about 180° of the delivery door 110.

In another aspect, the first section 104 and second section 106 may be substantially rectangular shape (one example is the square shape, described herein). For a rectangular shape that is not a square, there are only two different relative angular positions of the first section 104 and second section 106. A first position in which the access door 114 and delivery door 110 are aligned on the same side of the receptacle 100, and a second position in which the access door 114 and delivery door 110 are on opposite sides of the receptacle 100 (i.e., front and back).

In another embodiment of a receptacle 100, the first section 104 and the second section 106 are configured such that they can be positioned rotationally at different relative angular positions about the vertical axis substantially continuously from 0° to 360°. For example, the first section 104 and second section 106 may have substantially circular shapes at least at their connection interface, so that the first section 104 and second section 106 can be positioned rotationally at any relative angular position. Alternatively, the first section 104 and second section 106 may have mating interfaces which allow them to be positioned rotationally at any relative angular position, such as respective circular interfaces formed in, or coupled to, each of the first section 104 and second section 106.

In another aspect of one embodiment of the receptacle 100, the first section 104 has a bottom portion 120 and the second section 106 has a top portion 122. The bottom portion 120 of the first section 104 and the top portion 122 of the second section 106 are configured to securely attach to each other via an interface 124 at each of the different angular positions of the first section 104 and second section 106 relative to each other. In still another aspect, the bottom portion 120 of the first section 104 and the top portion 122 of the second section 106 have a substantially rectangular shape at the interface. In yet another aspect, the bottom portion 120 of the first section 104 and the top portion 122 of the second section 106 may have a substantially polygonal shape at the interface 124. In still another aspect, the bottom portion 120 of the first section 104 and the top portion 122 of the second section 106 may have a substantially circular shape at the interface 124.

In another aspect, the receptacle 100 may further comprise an extender section (not shown) configured to be positioned between, and to attach to, the first section 104 and the second section 106. The extender section has an interior open space to allow an object to pass from the first section 104, through the extender section, and into the storage compartment 107 of the second section 106. The extender section may be configured to securely attach to at least one of the first section 104 and second section 106 at different angular positions relative to the at least one of the first section 104 and second section 106 to allow the first section 104 and second section 106 to be positioned rotationally at the different angular positions relative to each other. The extender section may be attached to one or both of the first section 104 or second section 106 to allow the first section 104 to swivel with respect to the second section. The amount of rotation of the swivel may be fixed during use, or allowed to continue during use of the receptacle 100. Both of the attachment points to the first section 104 and second section 106 may be configured to reduce water ingress into the storage compartment 107.

In still another aspect, the receptacle 100 is configured such that the first section 104 and second section 106 can be shipped separately in respective shipping containers or parcels that do not require oversize shipping surcharges. For instance, United Parcel Service (UPS) charges an oversize surcharge for parcels having a length plus girth (where girth is defined as=(2×width)+(2×height) exceeding 118 inches. Similarly United States Postal Service (USPS) charges an oversize surcharge for parcels having a length+girth (length=the longest dimension and girth=the distance around thickest part of parcel) exceeding 108 inches. And Federal Express charges an oversize surcharge for parcels having a length+girth exceeding 130 inches. Thus, the first section 104 and second section 106 may each be configured to be shipped in separate parcels not exceeding one or more of these oversize parcel limitations.

In yet another aspect, the angular position of the first section 104 relative to the second section 106 can be adjusted while the first section 104 remains attached to the second section 106 in order to adjust the angular position of the delivery door 110 relative to the access door 114. For example, an embodiment having a first section 104 and second section 106 having a circular shape or a circular interface 124 with the bottom portion 120 of the first section 104 rotatably captured by the top portion 122 of the second section 106 or vice versa. In this embodiment, the first section 104 may pivot or swivel about a vertical axis extending through the second section 106 while attached to the second section. Alternatively, a non-circular embodiment, such as the rectangular (e.g., square) shape described herein may also be configured to allow the first section 104 and second section 106 to be rotated relative to one another using a rotational interface 124 that may be hidden from outside view. In these embodiments, the interface must have an interior opening to allow packages to travel from the input opening 108 to the storage area 107.

Figure 3:
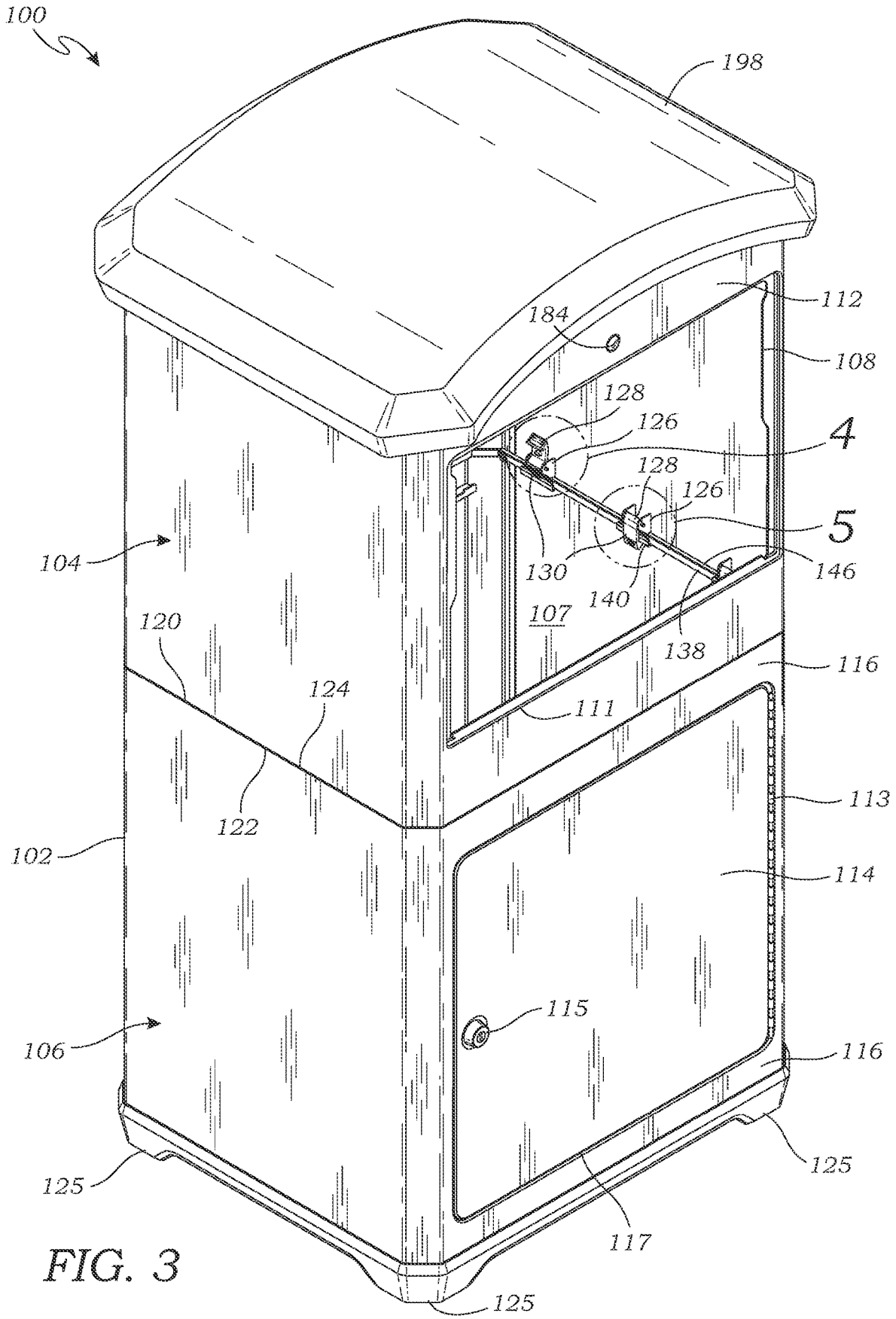
FIG. 3 is a perspective view of one embodiment of the inventive receptacle in a first orientation with the delivery door removed to show the interior of the receptacle and connection between the upper section and lower section.
Figure 7:
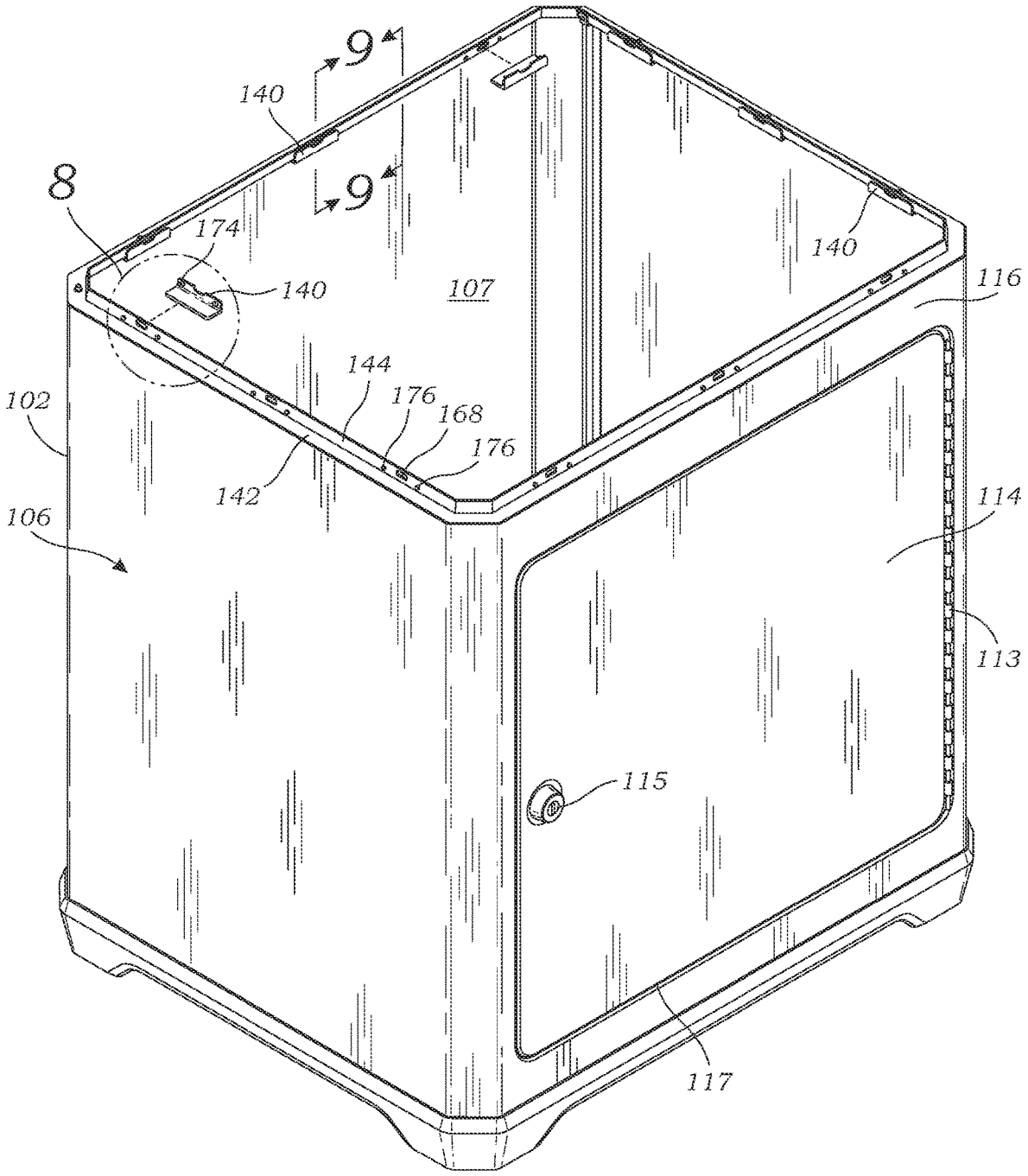
FIG. 7 is a perspective view of a second or bottom section of one embodiment.
Figure 8:
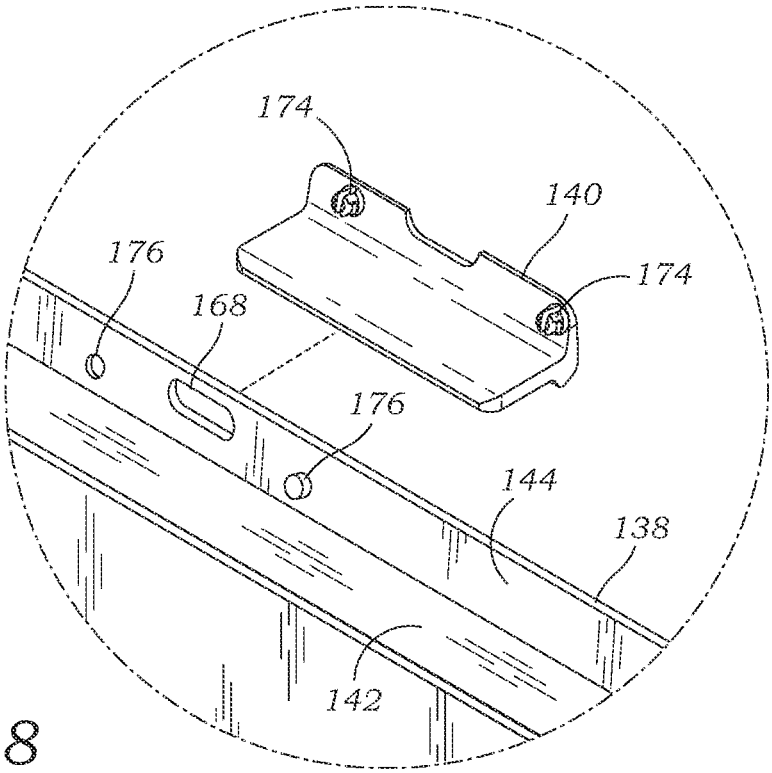
FIG. 8 is an exploded perspective detail of a portion of a connector in FIG. 7.
Figure 9:
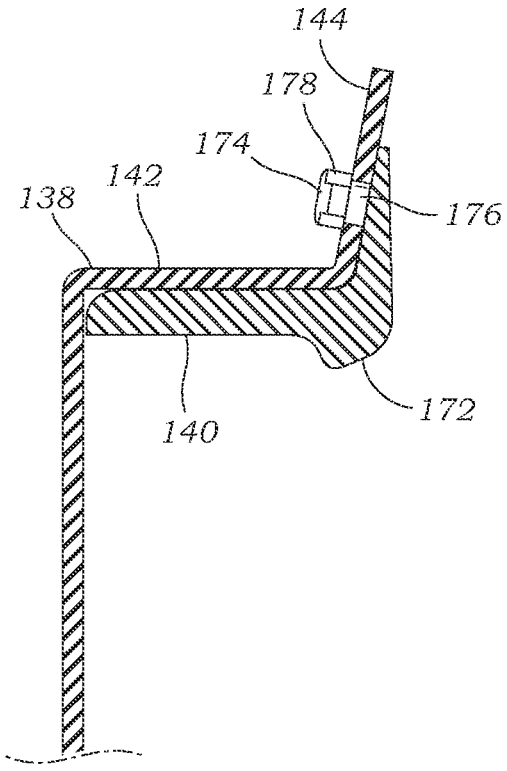
FIG. 9 is a cross sectional view of a portion of a connector in FIG. 7 taken along line 9-9 of FIG. 7.
Figure 10:
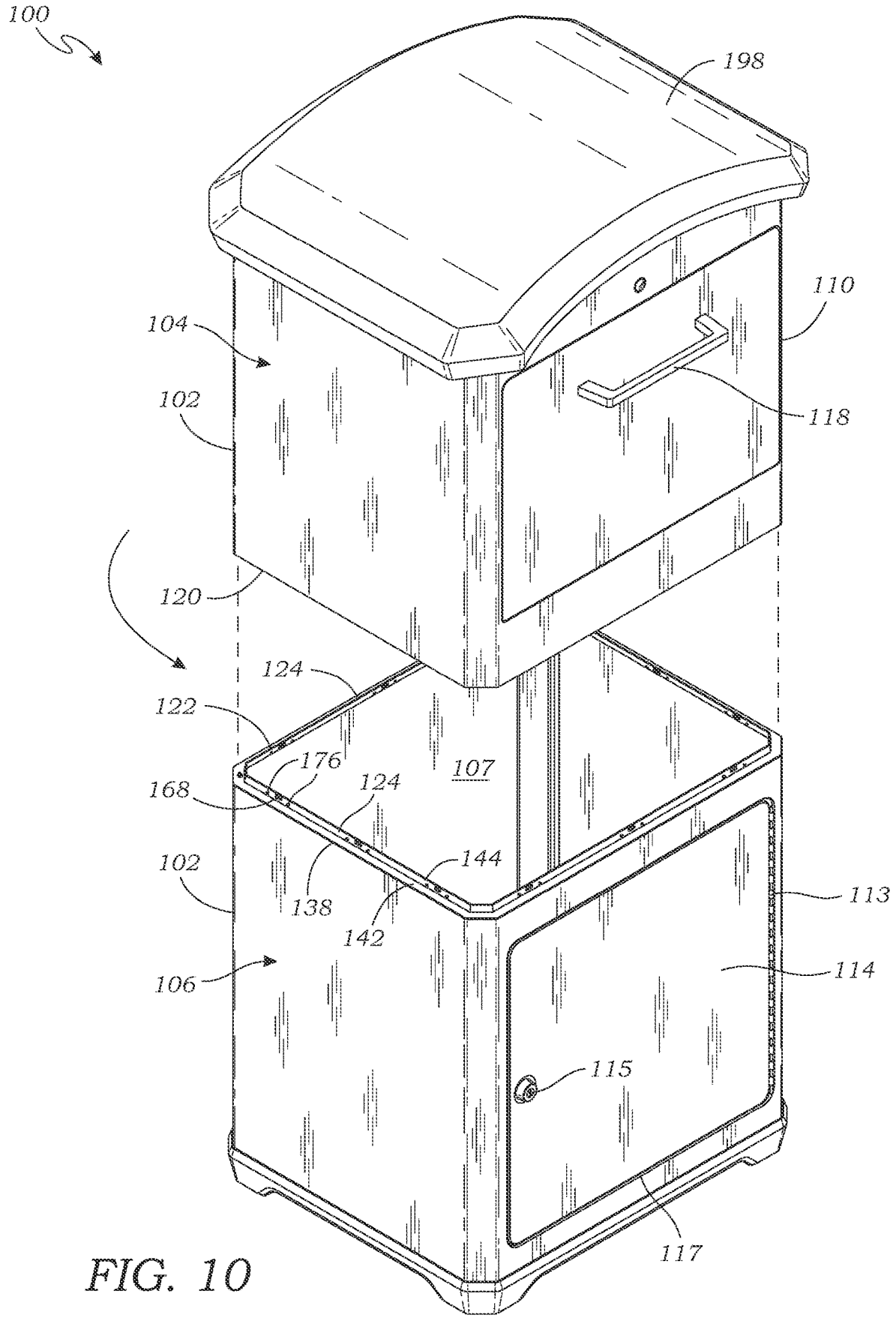
FIG. 10 is an exploded view of one embodiment of the receptacle in a first orientation.

In another aspect, as illustrated in the exemplary embodiment of FIGS. 3, 7, and 10, the first section 104 may be detachable from the second section 106 using one or more releasable or removable fasteners 126. In addition, the receptacle 100 may be configured such that the first section 104 may be detached from the second section 106 in order to adjust the angular position of the first section 104 relative to the second section 106 in order to adjust the angular position of the delivery door 110 relative to the access door 114.

Figure 4:
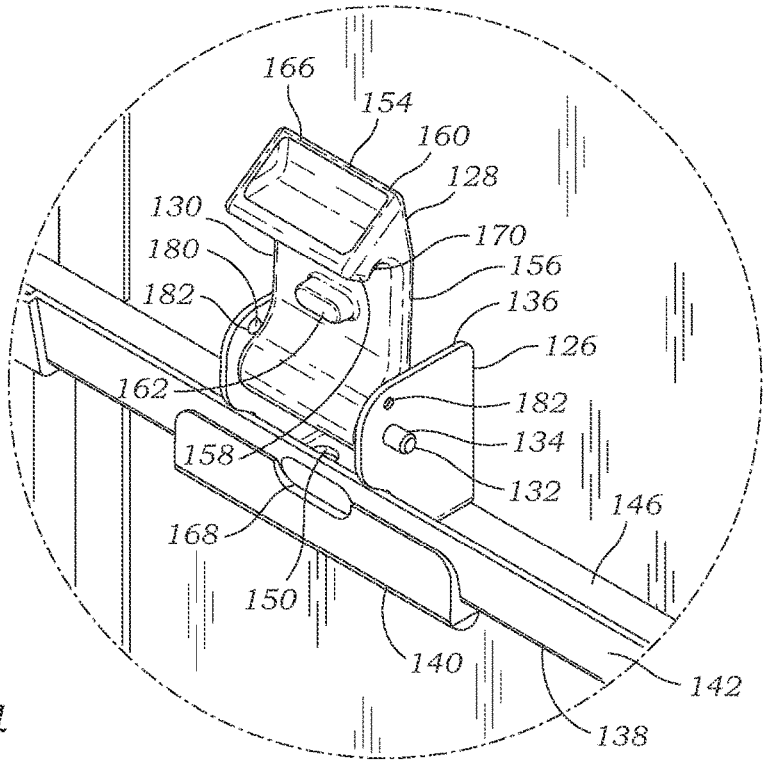
FIG. 4 is a perspective detail view of one embodiment of a connector for attaching the upper section to the lower section with the connector in the open condition as called out in lead line 4 of FIG. 3.
Figure 5:
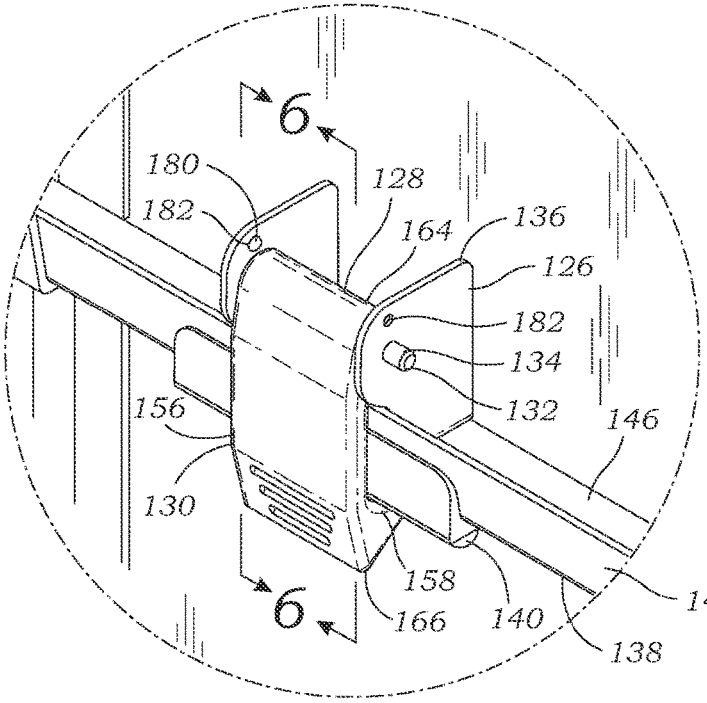
FIG. 5 is a perspective detail view of one embodiment of a connector for attaching the upper section to the lower section with the connector in the closed or locked condition as called out in lead line 5 of FIG. 3.
Figure 6:
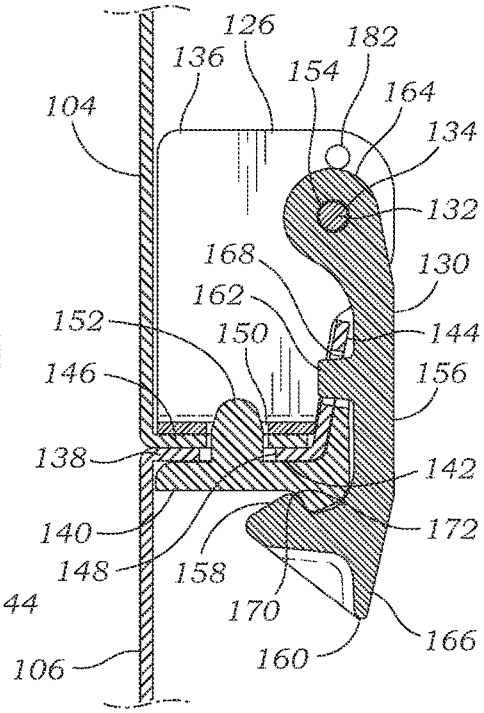
FIG. 6 is a cross sectional view of the connector of FIG. 5 taken along line 6-6 of FIG. 5.

As shown in FIGS. 3-9, the fasteners 126 may be clips 128 attached to the first section 104 which act as a latch 130 to releasably clip onto a catch 140 mounted on an inwardly extending ledge 138 on the upper portion 122 of the second section 106. Preferably, the ledge 138 has an inwardly extending substantially horizontal section 142 terminating in a more upstanding inwardly sloped vertical section 144. In a preferred embodiment, the bottom portion of the first section 104 has an inwardly extending lip 146. Upon assembly, the lip 146 nests onto the ledge 138 to reduce the possibility of rain or moisture from entering the storage compartment 107 from outside the receptacle 100. As seen in FIG. 6, the ledge horizontal section 142 may have an aperture 148 aligned with an aperture 150 in the lip 146. A pin or plug 152 associated with the catch 140 may extend upwardly through the ledge aperture 148 and the lip aperture 150 to assist in aligning the upper section 104 with the lower section 106 during assembly. In embodiments in which quick release fasteners 126 are not utilized, the aligned apertures 148 and 150 may be used to accept rivets or bolts or other threaded fasteners to enable the attachment of the first section 104 to the second section 106. In another embodiment, the first section 104 and the second section 106 may be more permanently attached as, for example, by welding. In another embodiment, one of the ledge horizontal section 142 and lip 146 may have a protrusion, such as a post, nub or dimple. The other of the horizontal section 142 and lip 146 may have a coordinating recess or aperture for aid in aligning the first section 104 to the second section 106 during assembly.

Various suitable fasteners or fastening systems may be utilized. In another aspect, the one or more fasteners are quick-release fasteners 126 in order to allow the first section 104 and second section 106 to be quickly and easily attached and detached. In one embodiment, the releasable fasteners 126 comprise a clip 128 preferably made of a resilient plastic that rotates about a horizontal axis 132 defined by a pin 134. The pin is held in place on the lip 146 at the bottom of the first section 104 by a bracket 136 that is suitably affixed to the lip 146 and bottom portion of the first section 104 for example by welding. The clip 128 has an aperture 154 near its proximate end 164 that allows it to rotate from an open condition as seen in FIG. 4 to a closed or locked condition as seen in FIGS. 5 and 6, in which the first section 104 is releasably secured to the second section 106. A main body portion 156 of the clip extends between the proximate end 164 and a distal end 166. The very distal end 166 has a handle 160 to manipulate the clip 128 to rotate it about the axis 132. A tongue 158 extends generally transversely from the body 156 of the clip to cooperate with the catch 140 (see FIGS. 5 and 6) for attachment. The tongue 158 may have a nub 170 that cooperates with a notch 172 on the catch 140 to enhance the security of the attachment. The security of the attachment may be further enhanced by a retainer 162 extending from the body 156 of the clip 128 and through an elongated aperture 168 in the ledge vertical section 144.

The catch 140 may also be made of resilient material. In one embodiment, it is held onto the ledge 138 by pins 174 that extend through apertures 176 in the vertical section 144 on either side of aperture 168. The catch 140 may be held in place by an interference fit between the pins 174 and apertures 176 by a nut 178 secured to the pin 174.

In a further aspect of the invention, the latch portion 130 of the releasable fastener 126 includes a means 180 for maintaining the clip 128 in the open condition as seen in FIG. 4 until it is desired to attach the first section 104 of the receptacle 100 to the second section 106. In one embodiment, the bracket 136 may include at least one inwardly extending dimple 182 that cooperates with the side of the resilient clip 128 to releasably retain the clip 128 in the open condition during shipment and initial assembly. Once the first section 104 and second section 106 are positioned with the input opening 108 and the access door 114 in the desired orientation, the assembler can access the releasable fasteners 126 through the access door 114 and rotate the clips 128 into a locked condition. It can be appreciated that it is undesirable for the clips to be dangling below the lip 146 during shipment to reduce the total volume of the upper section 104 to minimize shipping costs as well as protect the clips 128 from possible damage. In another aspect of the invention, the releasable fasteners may be accessible from outside of the receptacle 100. In a further aspect, the clips 128 may be pivotally attached to the lower section 106.

In still another aspect, the receptacle 100 may further include adjustable leveling feet 125 disposed on a bottom of the second section 106. For instance, four leveling feet, one at each corner of the second section 106, may be utilized. In a further aspect, the second section 106 may be pivotally mounted on a base to allow the top 104 and bottom 106 sections to pivot together about a vertical axis. In still another aspect, the input opening 108 and delivery door 110 may be associated with the second section 106 and the access opening 117 and access door 114 associated with the upper section 104.

In yet another aspect, at least one of the first section 104 and the second section 106 is installed into a structure such as a fence 196 (as shown in FIG. 12) or a wall, so that the structure supports the at least one of the first section 104 and second section 106. FIG. 12 shows one such embodiment in which the first section 104 and second section 106 are both installed into a fence 196, with the first side 112 of the upper section 104 and delivery door 110 facing the public or street side of the fence 196 and the first side 116 of the second section 106 and access door 114 facing the private or house side of the fence 196.

In still another aspect, the first section 104 and second section 106 may both be installed in a structure such as a wall or a column in spaced apart relation to one another. The structure has an interior open space to allow an object to pass from the first section 104, through the interior open space of the structure, and into the storage compartment 107 of the second section 106. Since the receptacle may be mounted in many varied locations and structures, it can be appreciated that the upper section 104 may be pivotable about the lower section 106 in other axes than a vertical axis.

Figure 2:
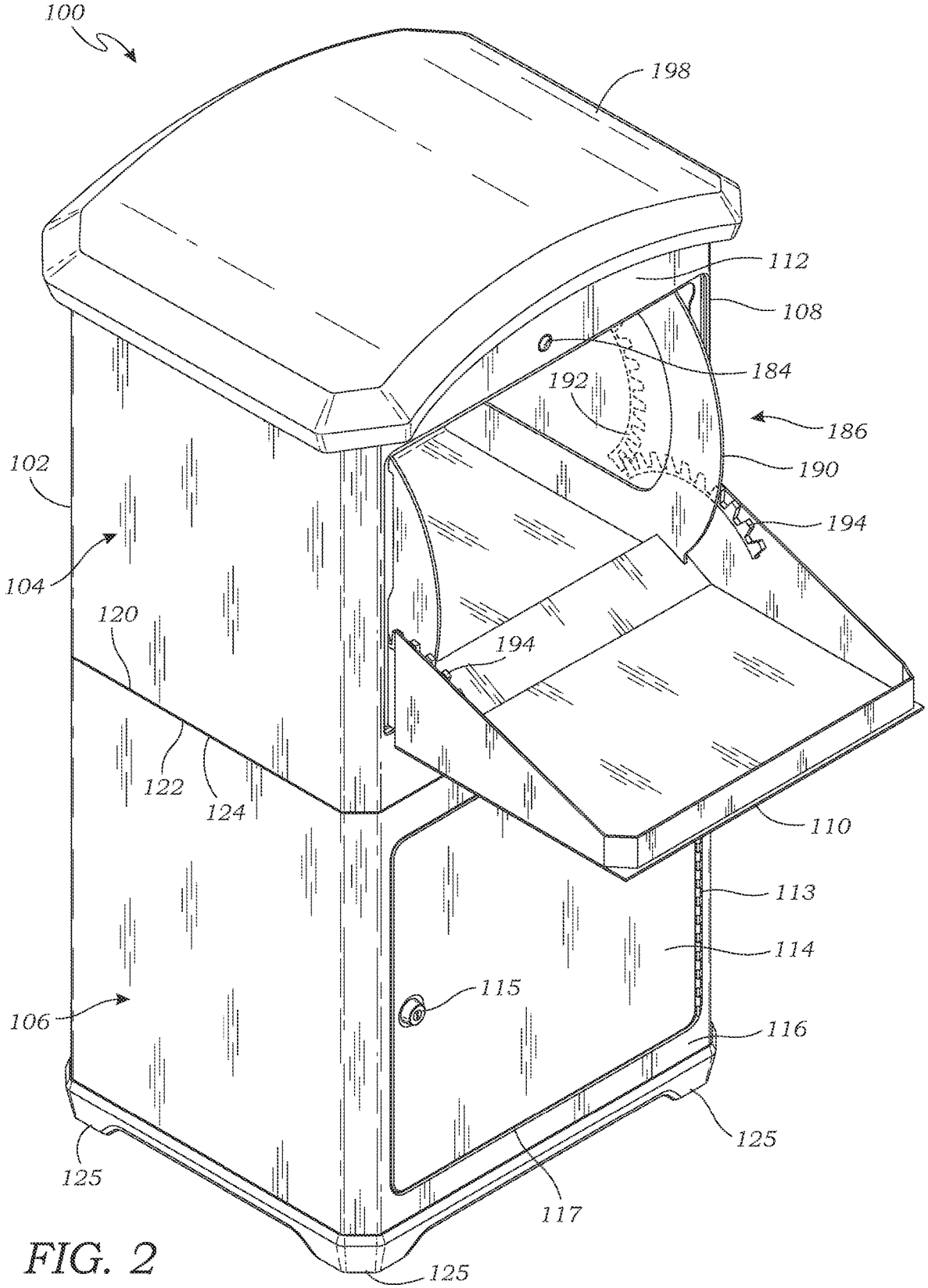
FIG. 2 is a perspective view of one embodiment of the inventive receptacle in a first orientation with the delivery door in the open condition and the access opening covered by a door in the closed condition.

The receptacle 100 may also have one or more cameras 184, and or other sensors, and a communications device for transmitting video from the cameras 184 to a monitoring system, such as a computer (e.g., a local monitoring system at the location of the receptacle 100, and/or a remote monitoring system, such as a security company system or the internet of things) for monitoring the receptacle 100. A camera 184 may be located on first side 112 of the first section 104 just below the roof or top 198, as shown in FIGS. 1-3. The camera 184, or another camera 184, may be located in a delivery drum 190 rotatably coupled to the housing 102. A camera 184 or other sensor may also be located in the storage compartment 107 in order to detect when an object is stored in the storage compartment 107.

The receptacle 100 may also include a secure delivery door system 186 disposed in the first section 104. The delivery door system 186 is configured to allow a deliverer to deposit an object into the receptacle 100, while preventing access to the storage compartment 107 through the input opening 108. In one embodiment, the delivery door system 186 may comprise a lower extension (not shown) to the delivery door 110 that rotates into the first section 104 to restrict access to the storage compartment as the upper portion of the delivery door 110 is rotated away from the first section 104.

In another embodiment, the secure delivery door system 186 comprises a delivery drum 190 which is mechanically coupled by a linking mechanism 188 to the delivery door 110. In one embodiment, the linking mechanism comprises a first gear 192 fixed to the 140 delivery drum and a second gear 194 fixed to the delivery door 110. The first gear mates with the second gear such that rotation of the first gear in the first rotational direction causes the second gear to rotate in the opposite rotational direction. The linking mechanism 144 is configured such that rotation of the delivery door 110 in a first rotational direction between the open position and the closed position causes the drum to rotate in an opposite rotational direction (a second rotational direction) between a loading position and an unloading position. The delivery door 110, delivery drum 190 and linking mechanism 188 are configured such that when the delivery door 110 is in the open position, the delivery drum 190 is in the loading position which allows an object to be placed through the input opening 108 into the delivery drum 190, and when the delivery door 110 is in the closed position, the delivery drum 190 is rotated to the unloading position in which the delivery drum 190 deposits the object into the storage compartment 107. The relative movement and position of the delivery drum 190 and delivery door 110 work together to restrict access through the input opening 108 and into the storage compartment 107 to secure the contents of the storage compartment 107 from unwanted access. Other secure delivery door systems 186 are described in co-owned U.S. Pat. Nos. 9,004,346 and 9,327,887, the disclosures of which are incorporated herein by reference.

In another embodiment, as best shown in FIGS. 13-16, the first section 104 with the input opening 108 and delivery door 110 form part of the bottom of the housing 102. The second section 106, with the access opening 117 and access door 114, are located above the first section 104. The second section is attached to the first section 104 at the interface 124. The interface is hollow or open to allow objects to travel from the first section 104 to the storage compartment 107 in the second section 106. Interfaces similar to those described for the exemplary embodiment of FIGS. 1-12 are also appropriate for this embodiment. The top of the second section 106 has a roof 198 to create a secure space and repel moisture and the elements.

As in the exemplary embodiment shown in FIGS. 1-12, in the exemplary embodiment in FIGS. 13-16, the first section 104 and second section 106 have substantially square shapes (i.e., length of the sides are equal about a vertical axis), including at their connection interface. Accordingly, there are four different relative angular positions of the first section 104 and second section 106, and the corresponding input opening 108 and delivery door 110 on one hand and access opening 117 and access door 114, on the other hand including:

the access door 114 substantially vertically aligned with delivery door 110;

the access door 114 located to the right of the delivery door 110 (i.e. 90° to the right);

the access door 114 located to the left of the delivery door 110 (i.e. 90° to the left); and the access door 114 located substantially behind the delivery door 110 (i.e. 180° from the delivery door 110).

Figure 13A:
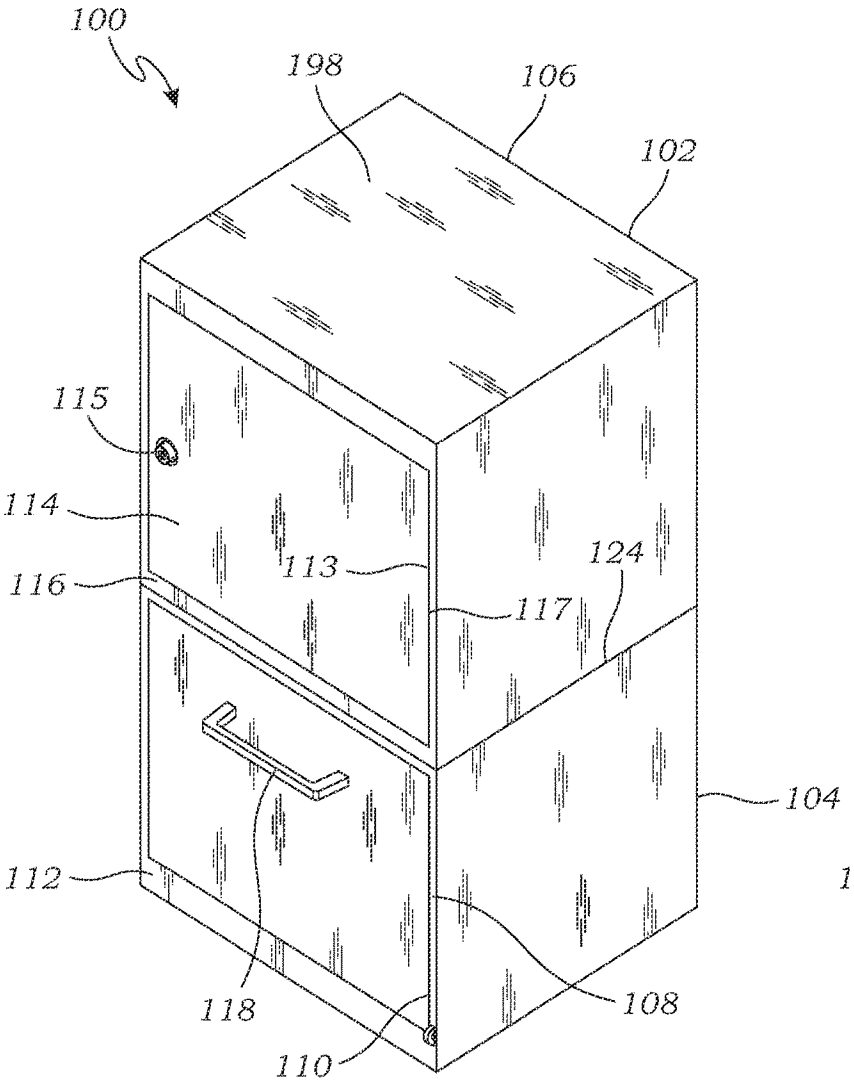
FIG. 13A is a perspective view of a second embodiment of the inventive receptacle in a first orientation with the delivery door and the access opening covered by a door in the closed condition.
Figure 14B:
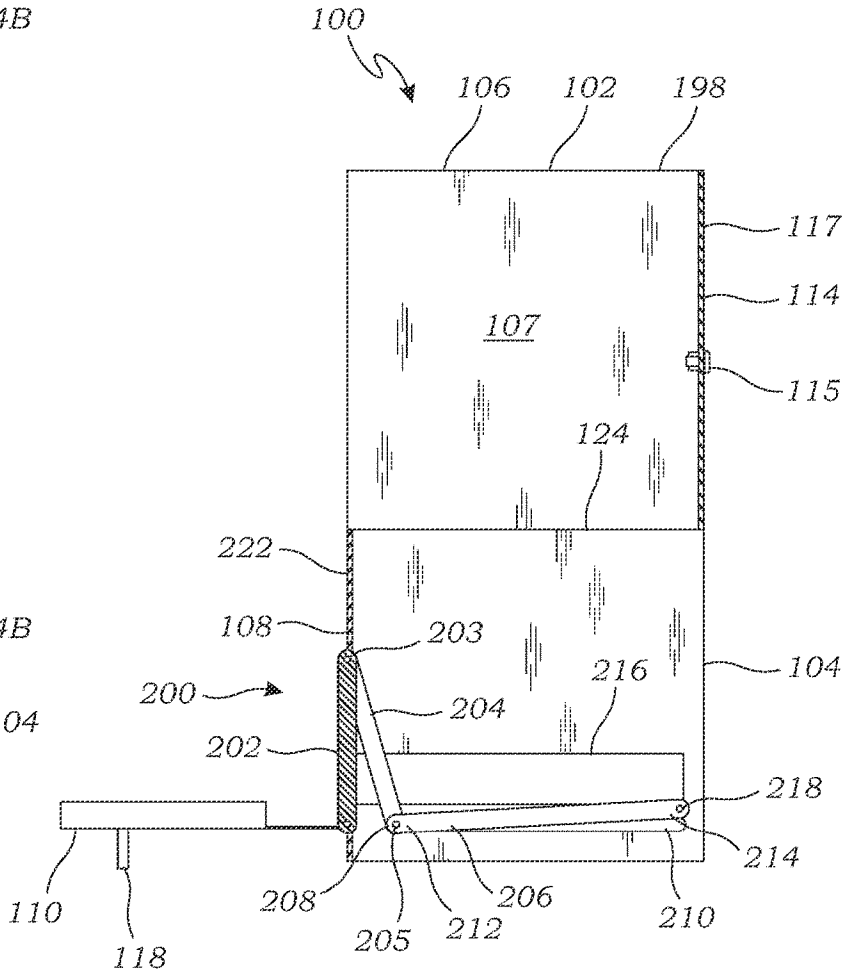
FIG. 14B is a cross sectional side view of a second embodiment of the inventive receptacle in a second orientation taken along line 14B-14B of FIG. 14A.
Figure 14A:
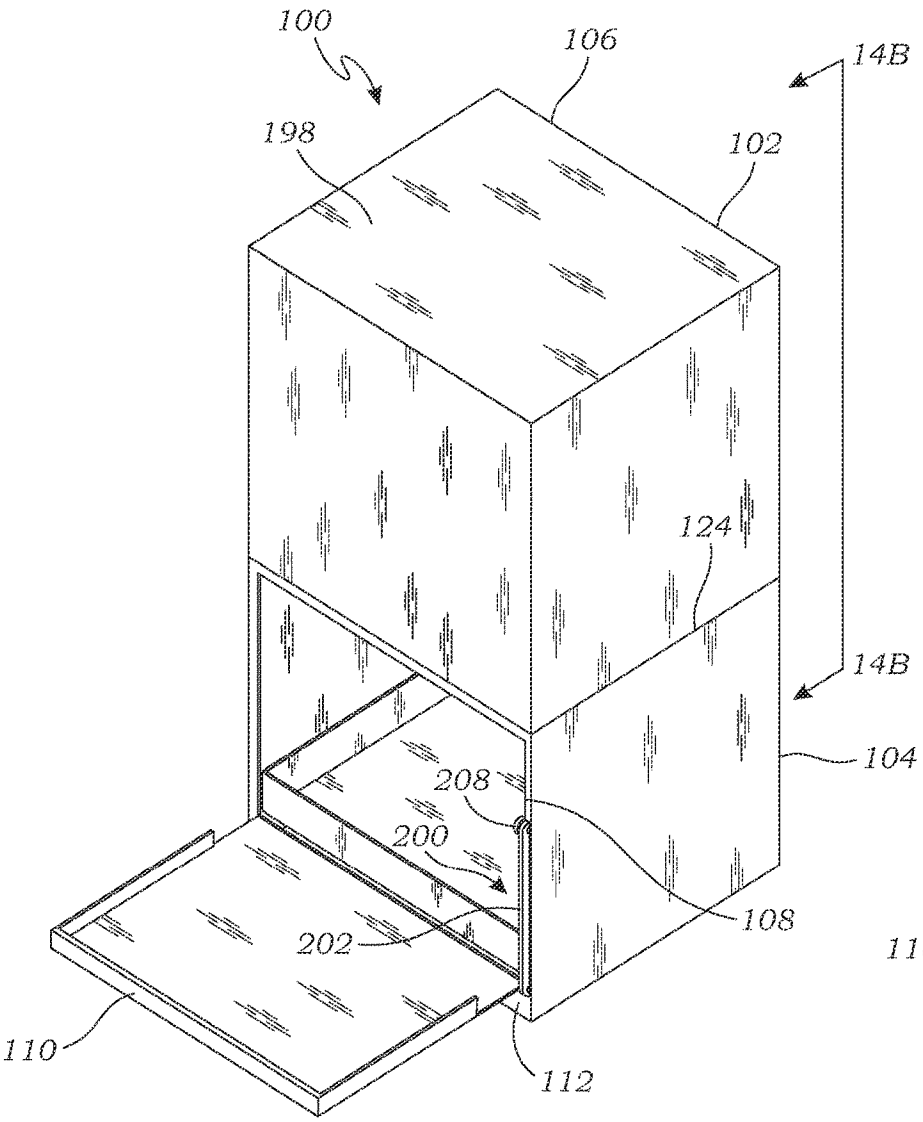
FIG. 14A is a perspective view of a second embodiment of the inventive receptacle in a second orientation with the delivery door in the open condition and the access opening covered by a door in the closed condition.

FIG. 13A shows the access door 114 vertically aligned with the delivery door 110, whereas FIGS. 13B-16B show the access door 114 substantially behind the deliver door 110.

As can be appreciated, in the exemplary embodiment in FIGS. 1-12, with the first section 104 above the second section 106, objects avail themselves of gravity to travel from the first section 104 to the storage area 107 of the second section. In the second embodiment in FIGS. 13-16, a lifting mechanism 200 moves the objects from the first section 104 to the second section 106. In the exemplary embodiment of FIGS. 13-16 the lifting mechanism comprises a set of linkages 202, 204 and 206, and a tray that moves vertically in a groove 222. More specifically, the delivery door 110 is rigidly attached to a first link 202 at the horizontal pivot axis of the delivery door, and thus the rigid pivot point of the first link 202. As seen from the right side in cross sectional views in FIGS. 14B, 15B and 16B, as the delivery door rotates clockwise from an open position to a closed position, the first link also rotates clockwise. The first link 202 is rotationally linked to a second link 204 at the second link's first end 203. The second link 204 is rotationally linked to a third link 206 at the second link's second end 205. In a preferred embodiment, there are two sets of links, one on either side of the delivery door attached to two sides of the tray 216.

The pin 208 connecting the second end 205 of the second link 204 to the first end 212 of the third link slides in a substantially horizontal track 210. Thus, when the delivery door 110 goes from the open position to a closed position, the pin 208 moves from left to right along the track 210, as seen from the right of the receptacle 100. This forces the first end 212 of the third link 206 to also move to the right along the track 210. The second end 214 of the third link is rotationally linked to one end of a receiving tray 216 by pin 218. The opposite end of the tray 216 has a pair of protrusions 220 of vertical extent that slide in a pair of vertical grooves 222 adjacent either side of the input opening 108. Accordingly, when the delivery door goes from an open position to a closed position, the third linkage 206 rotates counterclockwise as seen from the right of the receptacle. This forces the tray 216 to rise, and when the delivery door is closed, as seen in FIG. 16B, the tray fills the interface 124 and any object in the tray is located in the storage area 107 of the second section 106. In one embodiment, the pin 218 may be located intermediate between the front and the back of the tray 216 so the upward force from the third link 206 is more in the middle of the tray. It can be appreciated that when the delivery door 110 goes from a closed position to an open position, the lift mechanism moves the tray from the interface 124 to a lowered position able to accept objects.

In one embodiment, in order to maintain the security of the object in the storage area 107, the rising of the tray 216 triggers a locking mechanism (not shown) into a locked state when the tray is proximate the interface 124. This locking mechanism prevents the tray 216 from being lowered from the interface 124 until the object is removed through the access opening 117 by unlocking the access door lock 115 and opening the access door 114. Various means can be associated with unlocking the locking means. In one embodiment, the opening of the access door 114 unlocks the locking mechanism.

In other embodiments, the lifting of the tray 216 may end with rotation of the tray 216 to result with it slanting toward the access opening 117. In this embodiment, the access door 114 may be removed. Thus, an object that is on the tray during lifting will ultimately slide off the tray, through the access opening 117 and into a second secure storage area adjacent the storage area 107. This embodiment may not require a locking mechanism, but may require a sensor to verify that the object has slid off the tray.

Lifting mechanisms 200 other than those employing linkages are contemplated in the invention. For example, gears, hydraulics or electro-motive apparatus may be employed to move the object from the first section 104 to the second section 106. Horizontal motion of the object is also contemplated. For example, a delivery door 110 pivoting on a vertical axis could be utilized with appropriate links or gears to slide an object horizontally into a storage area 107 in a second section 106 of receptacle 100.

Various embodiments disclosed herein are to be taken in the illustrative and explanatory sense, and should in no way be construed as limiting of the present disclosure. While aspects of the present disclosure have been particularly shown and described with reference to the embodiments above, it will be understood by those skilled in the art that various additional embodiments may be contemplated by the modification of the disclosed receptacles, systems and methods without departing from the spirit and scope of what is disclosed. Such embodiments should be understood to fall within the scope of the present disclosure as determined based upon the claims and any equivalents thereof.

What is claimed is:

1. A receptacle for receiving and securing an object, comprising:

a housing including, i) a first section having an input opening located on a first side of the first section for receiving an object being deposited into the receptacle, and ii) a separate second section forming a storage compartment for receiving and securely storing an object deposited into the receptacle;

a delivery door mounted on the first side of the first section, the delivery door rotatable between a closed position in which the delivery door blocks the input opening and an open position in which the delivery door allows access through the input opening to place an object into the receptacle and allow the object to enter into the storage compartment;

an access opening located on a first side of the second section configured to provide access to the storage compartment for removing objects deposited into the receptacle; and, an access door mounted on the first side of the second section rotatable between a closed position in which the access door blocks the access opening and an open position in which the access door allows access into the storage compartment for retrieving an object in the storage compartment;

wherein the first section and the second section are configured such that they can be positioned rotationally about a substantially vertical axis at different angular positions relative to each other to allow the input opening and the access opening to be located at different angular positions relative to each other while still allowing an object deposited through the access opening to enter into the storage compartment and be securely stored in the storage compartment; and, wherein the delivery door is positioned at a front of the receptacle, and the second section can be angularly positioned relative to the first section about the vertical axis to position the access door at least at the following angular positions relative to the delivery door;

the access door positioned at the front of the receptacle such that it is substantially vertically aligned with the delivery door;

the access door angularly positioned about 90° to the right of the delivery door;

the access door angularly positioned about 90° to the left of the delivery door; and the access door angularly positioned at a back of the receptacle at about 180° of the delivery door.

2. The receptacle of claim 1, further comprising:

an extender section configured to be positioned between, and attach to, the first section and the second section, the extender section having an interior open space to allow an object to pass from the first section, through the extender section, and into the storage compartment of the second section; and wherein the extender section is configured to securely attach to at least one of the first section and second section at different angular positions relative to the at least one of the first section and second section to allow the first section and second section to be positioned rotationally at the different angular positions relative to each other.

3. The receptacle of claim 1, wherein each of the first section and second section separately fit into a shipping container having a maximum length plus girth ((2×width)+(2×height)) of 118 inches.

4. The receptacle of claim 1, wherein each of the first section and the second section separately fit into respective shipping containers, in which each shipping container has a length+girth of less than 118 inches, wherein the length is the longest dimension of the shipping container and the girth is the perimeter of the thickest part of the shipping container.

5. A receptacle for receiving and securing an object, comprising:

a housing including, i) a first section having an input opening located on a first side of the first section for receiving an object being deposited into the receptacle, and ii) a separate second section forming a storage compartment for receiving and securely storing an object deposited into the receptacle;

a delivery door mounted on the first side of the first section, the delivery door rotatable between a closed position in which the delivery door blocks the input opening and an open position in which the delivery door allows access through the input opening to place an object into the receptacle and allow the object to enter into the storage compartment;

an access opening located on a first side of the second section configured to provide access to the storage compartment for removing objects deposited into the receptacle; and, an access door mounted on the first side of the second section rotatable between a closed position in which the access door blocks the access opening and an open position in which the access door allows access into the storage compartment for retrieving an object in the storage compartment;

wherein the first section and the second section are configured such that they can be positioned rotationally about a substantially vertical axis at different angular positions relative to each other to allow the input opening and the access opening to be located at different angular positions relative to each other while still allowing an object deposited through the access opening to enter into the storage compartment and be securely stored in the storage compartment; and, wherein the first section and the second section are configured such that they can be positioned rotationally at different relative angular positions about the vertical axis substantially continuously from 0° to 360°.

6. The receptacle of claim 5, wherein:

the first section has a bottom portion;

the second section has a top portion; and the bottom portion of the first section and the top portion of the second section are configured to securely attach to each other via an interface at each of the different angular positions of the first section and second section relative to each other.

7. The receptacle of claim 6, wherein the bottom portion of the first section and the top portion of the second section have a substantially square shape at the interface.

8. The receptacle of claim 7, wherein the bottom portion of the first section has a generally inwardly extending lip and the top portion of the second section has an inwardly extending ledge with an upwardly extending portion that cooperates with the lip to restrict water ingress into the storage compartment.

9. The receptacle of claim 6, wherein the bottom portion of the first section and the top portion of the second section have a substantially circular shape at the interface.

10. A receptacle for receiving and securing an object, comprising:

a housing including, i) a first section having an input opening for receiving an object being deposited into the receptacle, and ii) a separate second section forming a storage compartment for receiving and securely storing an object deposited into the receptacle;

a secure delivery door system associated with the input opening including a delivery drum mechanically coupled by a linking mechanism to a delivery door;

the linking mechanism configured such that rotation of the delivery door in a first rotational direction between the open position and the closed position causes the delivery drum to rotate in an opposite rotational direction between a loading position and an unloading position; and wherein the delivery door, delivery drum and linking mechanism are configured such that when the delivery door is in the open position, the delivery drum is in the loading position allowing an object to be placed through the input opening into the delivery drum, and when the delivery door is in the closed position, the delivery drum is in the unloading position in which the delivery drum deposits the object into the storage compartment; and an access door located on a first side of the second section configured to provide access to the storage compartment for removing objects deposited into the receptacle;

wherein the first section and the second section are configured such that they can be positioned rotationally about a substantially vertical axis at different angular positions relative to each other to allow the delivery door and the access door to be located at different angular positions relative to each other while still allowing an object deposited through the access opening to enter into the storage compartment and be securely stored in the storage compartment.

11. The receptacle of claim 10, wherein the relative movement and position of the delivery drum and delivery door work together to restrict access through the input opening and into the storage compartment to secure the contents of the storage compartment from unwanted access.

12. The receptacle of claim 11, wherein each of the first section and the second section separately fit into respective shipping containers, in which each shipping container is less than 48 inches along its longest side and less than 30 inches along its second longest side.

13. The receptacle of claim 10 wherein the first section is detachable from the second section using one or more releasable or removable fasteners, and the first section must be detached from the second section in order to adjust the angular position of the first section relative to the second section in order to adjust the angular position of the delivery door relative to the access door.

14. The receptacle of claim 13, wherein the one or more fasteners are quick-release fasteners.

15. The receptacle of claim 10, further comprising alignment posts disposed on one of the first section and second section and alignment apertures disposed on the other of the first section and second section, with the alignment apertures positioned to receive the alignment posts to guide assembly of the first section to the second section.

16. The receptacle of claim 10, further comprising one or more cameras disposed on the receptacle and a communications device for monitoring the receptacle.

17. A receptacle for receiving and securing an object, comprising:

a housing including, i) a bottom section having an input opening for receiving an object being deposited into the receptacle, and ii) a separate top section forming a storage compartment for receiving and securely storing an object deposited into the receptacle;

a delivery door located on a first side of the bottom section, the delivery door rotatable between a closed position in which the delivery door blocks the input opening and an open position in which the delivery door allows access through the input opening to place an object into the receptacle;

a lift mechanism associated with the delivery door to transport the object the object into the storage compartment while the delivery door changes from the open to the closed position;

an access door located on a first side of the top section configured to provide access to the storage compartment for removing objects deposited into the receptacle; and, a locking mechanism associated with the lift mechanism configured to lock the lift mechanism with the object in the storage compartment until the object is removed from the storage compartment through the access door;

wherein the top section and the bottom section are configured such that they can be positioned rotationally about a substantially vertical axis at different angular positions relative to each other to allow the delivery door and the access door to be located at different angular positions relative to each other while still allowing an object deposited through the input opening to enter into the storage compartment and be securely stored in the storage compartment.

18. The receptacle of claim 17 wherein the delivery door rotates about a horizontal axis and the lift mechanism comprises a set of linkages attached to the delivery door and a tray, with the lift mechanism configured to move the tray vertically as the delivery door rotates.

19. The receptacle of claim 18 wherein the locking mechanism is changed from an unlocked state to a locked state by movement of the tray and the locking mechanism is changed from the locked state to the unlocked state by movement of the access door.

* * * * *